US012302968B1

(12) United States Patent
Jordan

(10) Patent No.: US 12,302,968 B1
(45) Date of Patent: May 20, 2025

(54) SLEEVE GARMENT ASSEMBLIES

(71) Applicant: Jason M. Jordan, Shreveport, LA (US)

(72) Inventor: Jason M. Jordan, Shreveport, LA (US)

( * ) Notice: Subject to any disclaimer, the term of this patent is extended or adjusted under 35 U.S.C. 154(b) by 0 days.

(21) Appl. No.: 18/511,160

(22) Filed: Nov. 16, 2023

(51) Int. Cl.
*A41D 27/10* (2006.01)

(52) U.S. Cl.
CPC ..... *A41D 27/10* (2013.01)

(58) Field of Classification Search
CPC ..... A41D 15/007; A41D 27/10; A41D 27/08
See application file for complete search history.

(56) References Cited

U.S. PATENT DOCUMENTS 1,285,917 A * 11/1918 Bradley ..... A41D 1/04 2/92
1,854,821 A 4/1932 Barker
2,693,598 A 11/1954 Young
2,821,035 A 1/1958 Joseph
2,970,316 A * 2/1961 Silin ..... A45F 3/042 224/264
3,000,378 A 9/1961 Zieman
3,167,782 A 2/1965 Wilson et al.
4,229,833 A 10/1980 Cox et al.
4,709,307 A 11/1987 Branom
5,210,878 A 5/1993 Triche
5,909,801 A 6/1999 Coffman
8,453,265 B2 6/2013 Forte et al.
8,650,662 B2 2/2014 Decker
10,477,905 B1 * 11/2019 Sachs ..... A45F 4/12
10,939,709 B2 3/2021 Haynes
11,785,996 B2 10/2023 Bushby et al.
2008/0047044 A1 2/2008 Jones
2023/0332868 A1 10/2023 Cae et al.

* cited by examiner

*Primary Examiner* — Sally Haden
(74) *Attorney, Agent, or Firm* — R. Keith Harrison

(57) ABSTRACT

Sleeve garment assemblies include a plurality of interchangeable assembly accessories and a pair of assembly sleeves detachably attached to a selected one of the plurality of interchangeable assembly accessories.

3 Claims, 6 Drawing Sheets

SLEEVE GARMENT ASSEMBLIES

FIELD

Illustrative embodiments of the disclosure generally relate to specialty garments and the like. More particularly, illustrative embodiments of the disclosure relate to sleeve garment assemblies which include a pair of assembly sleeves that are donned by a wearer and multiple interchangeable assembly accessories which interconnect the assembly sleeves.

BACKGROUND

The background description provided herein is solely for the purpose of generally presenting the context of the illustrative embodiments of the disclosure. Aspects of the background description are neither expressly nor impliedly admitted as prior art against the claimed subject matter.

Various types of garments are worn for a variety of purposes. For example, costumes are commonly worn to impart a desired appearance for Halloween parties and the like. It may be desirable in many applications to customize the appearance of a costume or other garment to impart a desired appearance to the wearer.

Accordingly, sleeve garment assemblies which include a pair of assembly sleeves that are donned by a wearer and multiple interchangeable assembly accessories which interconnect the assembly sleeves are desired.

SUMMARY

Illustrative embodiments of the disclosure are generally directed to sleeve garment assemblies which include a plurality of interchangeable assembly accessories and a pair of structurally independent assembly sleeves detachably individually attached to a selected one of the plurality of interchangeable assembly accessories.

BRIEF DESCRIPTION OF THE DRAWINGS

Illustrative embodiments of the disclosure will now be described, by way of example, with reference to the accompanying drawings, in which.

DETAILED DESCRIPTION

Figure 1:
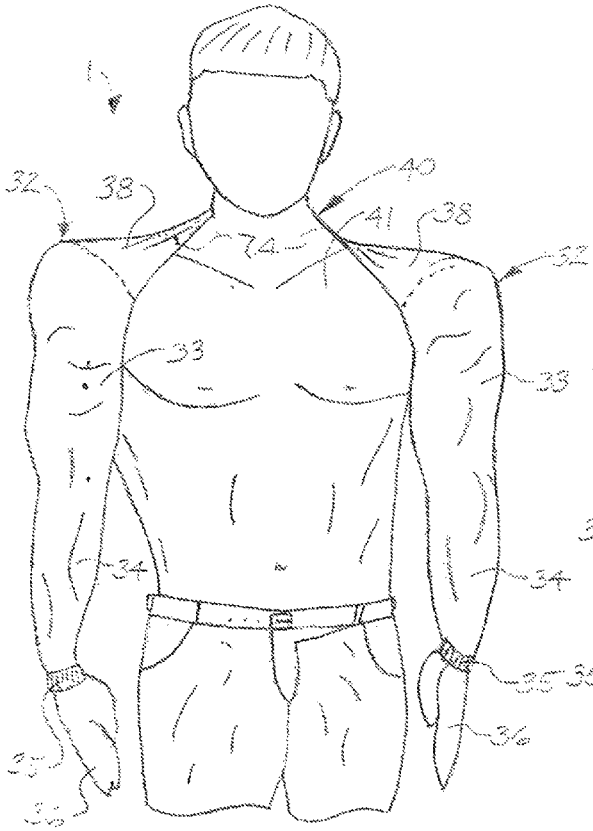
FIG. 1 is a front view of an illustrative embodiment of the sleeve garment assemblies, donned by a wearer.

The following detailed description is merely exemplary in nature and is not intended to limit the described embodiments or the application and uses of the described embodiments. As used herein, the word "exemplary" or "illustrative" means "serving as an example, instance, or illustration." Any implementation described herein as "exemplary" or "illustrative" is not necessarily to be construed as preferred or advantageous over other implementations. All of the implementations described below are exemplary implementations provided to enable persons skilled in the art to make or use the embodiments of the disclosure and are not intended to limit the scope of the disclosure, which is defined by the claims. For purposes of description herein, the terms "upper", "lower", "left", "rear", "right", "front", "vertical", "horizontal", and derivatives thereof shall relate to the invention as oriented in FIG. 1. Furthermore, there is no intention to be bound by any expressed or implied theory presented in the preceding technical field, background, brief summary or the following detailed description. It is also to be understood that the specific devices and processes illustrated in the attached drawings, and described in the following specification, are simply exemplary embodiments of the inventive concepts defined in the appended claims. Hence, specific dimensions and other physical characteristics relating to the embodiments disclosed herein are not to be considered as limiting, unless the claims expressly state otherwise.

All methods set forth in the present disclosure may be performed in any suitable order of steps unless otherwise indicated herein or contradicted by the rules of logic. The use of any and all examples or exemplary language provided herein is intended to clearly describe the subject matter of the disclosure and is not intended to be limiting on the scope of the subject matter set forth in the claims. No element, step, ingredient, or limitation mentioned or described in the specification shall not be construed as regarding any unclaimed component, step, or limitation to be essential in practicing the claimed subject matter.

Unless expressly or implicitly indicated otherwise, throughout the description and the appended claims, the terms "comprise", "comprising", "comprised of" and the like are to be construed in an inclusive sense as opposed to an exclusive or exhaustive sense, and are equivalent to the phrase, "including but not limited to". Each embodiment disclosed herein can comprise, consist essentially of, or consist of its particular stated element, step, ingredient, or limitation. As used herein, the transition terms "comprise", "comprises", "comprising", "include", "includes", "including", "is", "has", "having" or the like means "includes, but is not limited to, and allows for the inclusion of unspecified elements, steps, ingredients, or limitations, even in major amounts". The transitional phrase "consisting of" excludes any element, step, ingredient, or limitation not specified. The transition phrase "consisting essentially of" shall limit the scope of the embodiment to the specified elements, steps, ingredients, or limitations and to those that do not materially affect the embodiment.

Unless otherwise noted using precise or limiting terminology, all numbers which express quantities of ingredients throughout the specification and claims are to be understood as being approximations of the numerical value cited to express the quantities of those ingredients. As used throughout the specification and claims, the term "about" has the meaning reasonably ascribed to it by a person skilled in the art when used in conjunction with a stated numerical value or range, i.e., denoting from the exact stated value or range to somewhat more or somewhat less than the stated value or range, from a deviation of from 0% with respect to the stated value or range to up to and including 20% of the stated value or range in either direction.

Various illustrative embodiments of the disclosure are described herein. Variations on the described illustrative embodiments may become apparent to those of ordinary skill in the art in reading the specification, drawings and claims of the disclosure. Accordingly, the disclosure encompassed by the specification, claims and drawings includes all modifications and equivalents of the subject matter recited in the claims as permitted by applicable law. Additionally, any combination of the elements in all possible variations thereof is encompassed by the subject matter of the disclosure unless otherwise indicated herein.

Figure 2:
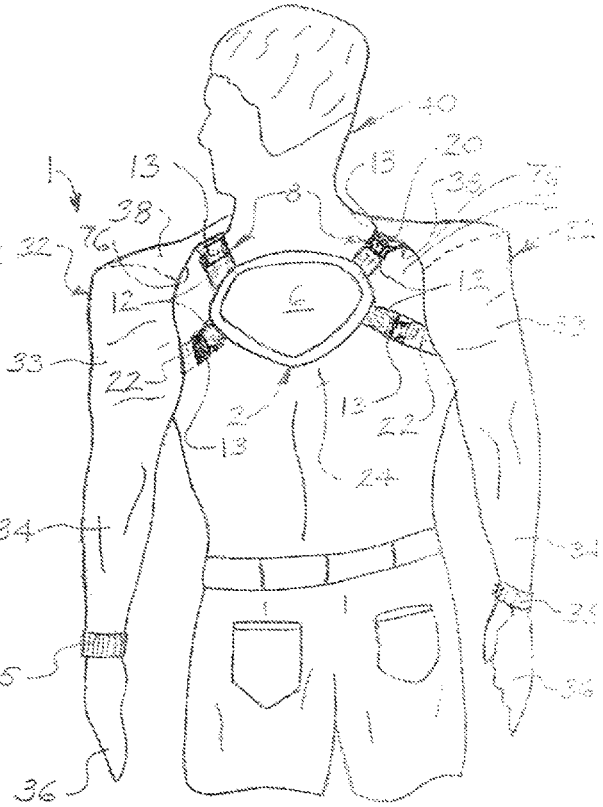
FIG. 2 is a rear view of the illustrative sleeve garment assembly donned by the wearer, with an assembly crest attaching the assembly sleeves to each other in the assembly.
Figure 3:
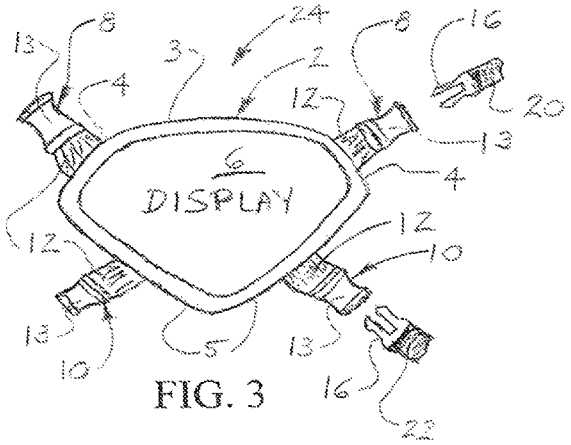
FIG. 3 is a partially-sectioned exploded front view of a typical assembly crest of the illustrative sleeve garment assembly.
Figure 4:
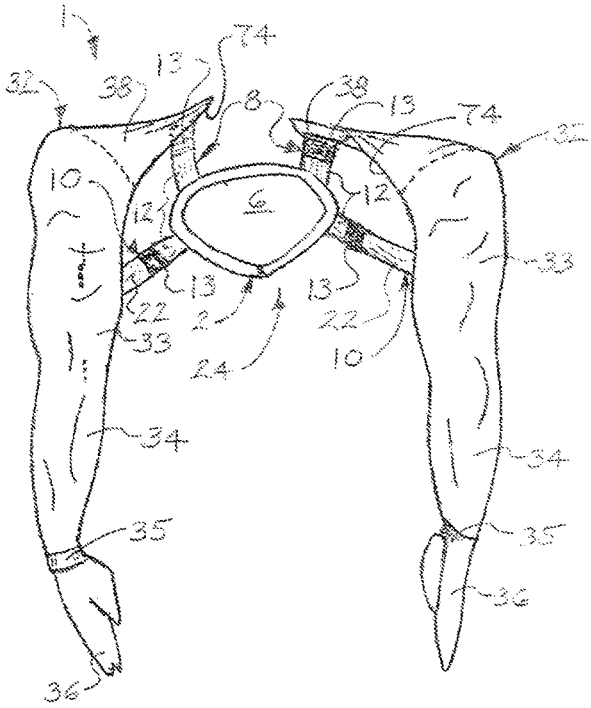
FIG. 4 is a front view of the illustrative sleeve garment assembly removed from the wearer.
Figure 5:
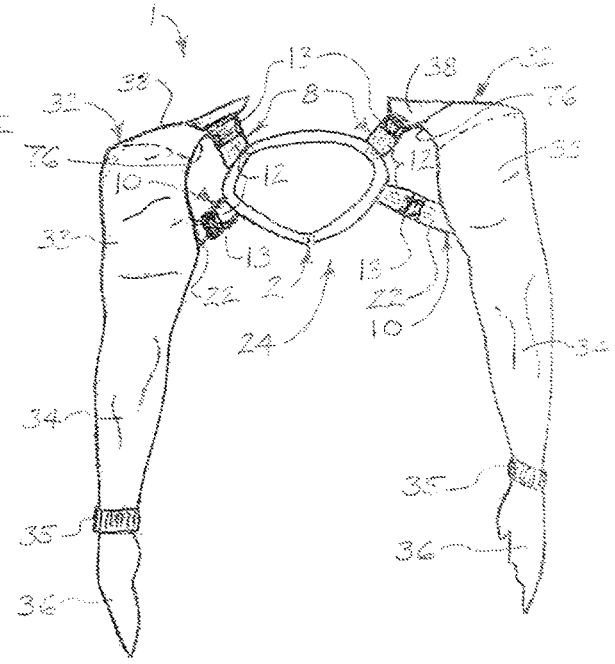
FIG. 5 is a rear view of the illustrative sleeve garment assembly removed from the wearer.

Referring initially to FIGS. 1-5 of the drawings, an illustrative embodiment of the sleeve garment assemblies is generally indicated by reference numeral 1. The sleeve garment assemblies 1 may include multiple interchangeable assembly accessories 24 which in some embodiments may include at least one assembly crest 2. A pair of assembly sleeves 32 may be donned by a wearer 40 and individually and detachably attached or fastened to a selected one of the assembly accessories 24 such that the assembly sleeves 32 are interconnected to each other through the selected assembly accessory 24, with the assembly accessory 24 typically situated over the upper back 42 (FIG. 2) or alternatively, over the chest 41 (FIG. 1) of the user 40. Accordingly, as illustrated in FIGS. 3-5, the assembly sleeves 32 may be structurally independent and individually and separately releasably fastenable to a selected one of the interchangeable assembly accessories 24. As used herein. "structurally independent" means that the assembly sleeves 32 are not fixedly or un-releasably attached to each other through any intermediary structure. As will be hereinafter further described, the assembly sleeves 32 may have different colors, textures, patterns and appearances and may be fabricated of various types of materials. Non-limiting examples of materials which are suitable for the assembly sleeves 32 include cotton, polyester, cotton/polyester blend, SPANDEX (trademark) and LYCRA (trademark). Thus, a selected pair of multiple interchangeable assembly sleeves 32 may be attached to the selected one of the multiple interchangeable assembly accessories 24 to impart a desired appearance to a wearer 40 as the wearer 40 dons the sleeve garment assembly 1. Accordingly, the sleeve garment assemblies 1 are highly customizable to accord with the aesthetic desires and tastes of the wearer. In some applications, the wearer 40 may include a human wearer. In other applications, the wearer 40 may include an animal. In still other applications, the wearer 40 may include a mannequin, dummy, stuffed animal or other likeness of a human or animal.

At least one assembly crest 2 of the assembly accessories 24 may be fabricated of a rigid or semi-rigid material such as plastic, lightweight metal, composite material or the like, or combinations thereof. As illustrated in FIG. 3, in some embodiments, the assembly crest 2 may include an upper crest edge 3, a pair of side crest edges 4 which angle downwardly and outwardly from the upper crest edge 3 and a pair of lower crest edges 5 which angle downwardly and inwardly toward each other from the respective side crest edges 4. The assembly crest 2 may have a display surface 6. In various embodiments, a selected logo, picture, slogan, player number, team name, light system, video screen, electronic display or the like (not illustrated) may be displayed on the display surface 6 of the assembly crest 2 according to the knowledge of those skilled in the art.

The assembly sleeves 32 may be detachably attached to the assembly crest 2 according to any suitable fastening technique which is known by those skilled in the art. Accordingly, as particularly illustrated in FIG. 3, in some embodiments, a pair of upper straps 20 and a pair of lower straps 22 (one of which is illustrated) may attach the assembly sleeves 32 to the assembly crest 2. A pair of upper strap connectors 8 may attach the upper straps 20 to the assembly crest 2. Similarly, a pair of lower strap connectors 10 may attach the lower straps 22 to the assembly crest 2. As further illustrated in FIG. 3, each of the upper strap connectors 8 and each of the lower strap connectors 10 may include a receiver strap 12 which extends from the assembly crest 2. A tab receiver 13 may be provided on each receiver strap 12. In some embodiments, the receiver straps 12 of the upper strap connectors 8 may extend from the respective side crest edges 4 of the assembly crest 2, as further illustrated in FIG. 3. The receiver straps 12 of the lower strap connectors 10 may extend from the respective lower crest edges 5 of the assembly crest 2. Each upper strap 20 and each lower strap 22 may terminate in a connector tab 16 which is releasably inserted in the companion tab receiver 13 of the corresponding upper strap connector 8 or lower strap connector 10. Accordingly, in some embodiments, the tab receiver 13 and the connector tab 16 of each upper strap connector 8 and lower strap connector 10 may include a conventional quick connect/disconnect coupling known by those skilled in the art. However it will be recognized and understood that various other types of connector mechanisms known by those skilled in the art such as buckles, snaps, hook and loop fasteners and the like, for example and without limitation, may be used as the upper strap connectors 8 and the lower strap connectors 10.

Each assembly sleeve 32 of the sleeve garment assembly 1 may include an upper arm segment 33 which may be generally elongated and is configured to enclose the upper arm portion (not illustrated) of the wearer 40. An accessory attachment flap 38 may extend from an upper end of the upper arm segment 33. A forearm segment 34 may extend from a lower end of the upper arm segment 33. The forearm segment 34 may be configured to enclose the forearm (not illustrated) of the wearer 40. A wristband 35 may terminate the forearm segment 34. The wristband 35 may include an elastic material which snuggly fits around the wrist of the wearer 40. In some embodiments, a glove 36 may extend from the wristband 35. The glove 36 may fit on the hand (not illustrated) of the wearer 40. In some embodiments, each assembly sleeve 32 may have a front sleeve portion 74 (FIG. 1) and a rear sleeve portion 76 (FIG. 2). In attachment of the assembly sleeves 32 to the assembly crest 2, the upper straps 20 (FIG. 3) may be sewn or otherwise attached to the accessory attachment flaps 38 of the respective assembly sleeves 32. The lower straps 22 may be similarly sewn or otherwise attached to the upper arm segments 33 of the respective assembly sleeves 32. In some embodiments, the upper straps 20 and the lower straps 22 may be attached to the rear sleeve portion 76 of each assembly sleeve 32, as illustrated in FIG. 2. In other embodiments, the upper straps 20 and the lower straps 22 may be attached to the front sleeve portion 74 (FIG. 1) of each assembly sleeve 32. The upper strap connectors 8 may be fastened by inserting the connector tab 16 on the upper straps 20 into the respective companion tab receivers 13. Likewise, the lower strap connectors 10 may be fastened by inserting the connector tabs 16 on the lower straps 22 into the respective companion tab receivers 13.

In typical application, the sleeve garment assembly 1 is donned by the wearer 40 to impart a desired appearance to the wearer 40 in such applications as costume parties, sporting events, participation in team sports and the like. Accordingly, the assembly sleeves 32 may initially be donned by the wearer 40 by inserting the wearer's hands and arms (not illustrated) through the upper arm segments 33, the forearm segments 34, the wristbands 35 and the groves 36, respectively, of the respective assembly sleeves 32. With the accessory attachment flaps 38 positioned over the respective shoulders of the wearer 40, the assembly accessory 24 may then be attached to the assembly sleeves 32, as illustrated in FIG. 2, by fastening the upper strap connectors 8 to the respective upper straps 20 and the lower strap connectors 10 to the respective lower straps 22. Thus, as further illustrated in FIG. 2, the assembly accessory 24 interconnects and maintains the assembly sleeves 32 in position on the respective arms of the wearer 40. In the non-limiting exemplary application illustrated in FIGS. 1 and 2, the assembly accessory 24 may be attached to the rear sleeve portions 76 of the respective assembly sleeves 32 such that the assembly accessory 24 is worn over the upper back 42 of the wearer 40, as illustrated in FIG. 2. Thus, as illustrated in FIG. 1, the chest 41 of the wearer 40 may remain exposed and appear visible between the assembly sleeves 32. Alternatively, the wearer 40 may don a shirt (not illustrated) and/or other garment beneath or over the sleeve garment assembly 1. The display surface 6 on the assembly crest 2 of the assembly accessories 24 may face rearwardly and may be visible to bystanders for display of the design which is provided on the display surface 6. In other non-limiting exemplary applications, the assembly crest 2 or other assembly accessory 24 may be attached to the front sleeve portions 74 (FIG. 1) of the respective assembly sleeves 32 such that the assembly accessory 24 is worn over the chest 41 of the wearer 40. Thus, the upper back 42 (FIG. 2) of the wearer 40 may remain exposed and appear visible between the assembly sleeves 32.

Figure 10:
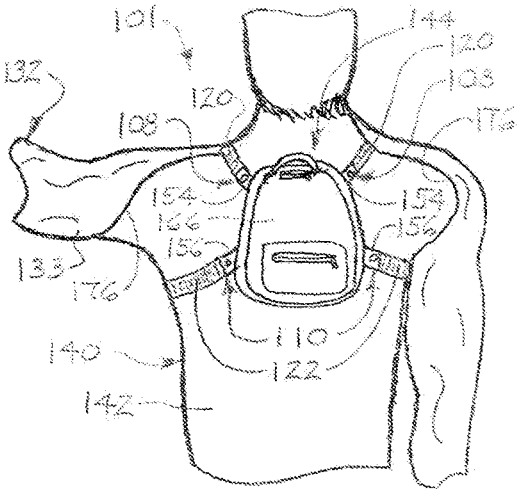
FIG. 10 is a rear view of the illustrative sleeve garment assembly donned by a wearer, with an assembly backpack replacing the assembly crest of FIG. 6 and interconnecting the assembly sleeves to each other in the assembly.
Figure 11:
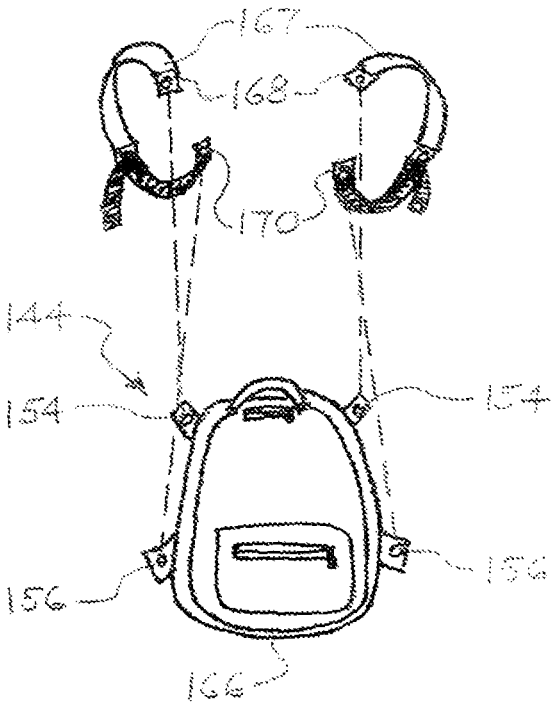
FIG. 11 is an exploded rear view of the assembly backpack of the sleeve garment assembly illustrated in FIG. 10, more particularly illustrating attachment of a pair of backpack straps to the assembly backpack in typical use of the assembly backpack without the assembly.
Figure 12:
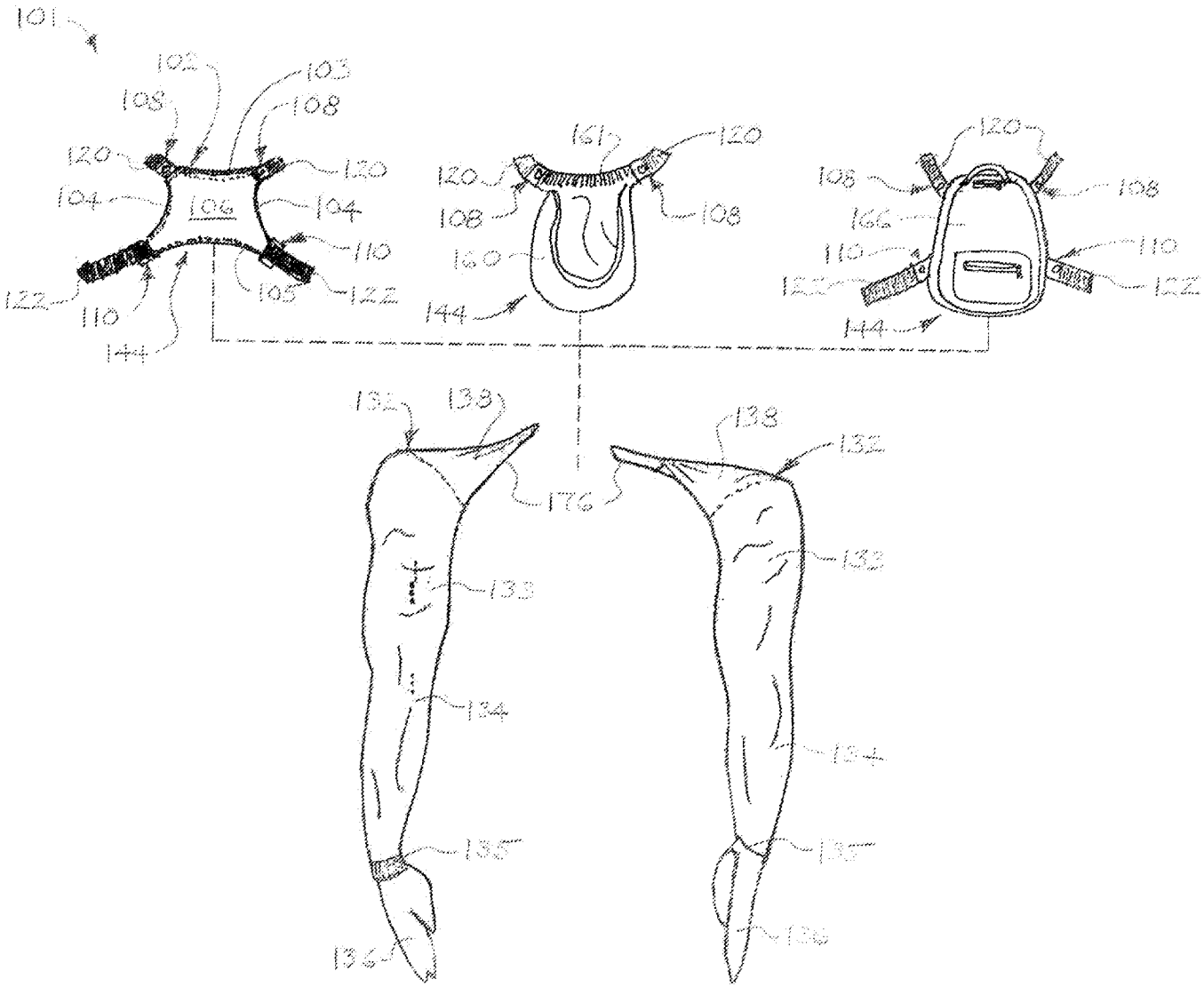
FIG. 12 is an exploded rear view illustrating interchangeable attachment of a pair of assembly sleeves to various interchangeable assembly accessories of the sleeve garment assembly illustrated in FIGS. 7-10.

Referring next to FIGS. 6-12 of the drawings, an alternative illustrative embodiment of the sleeve garment assembly is generally indicated by reference numeral 101 in FIGS. 7-10 and 12. In the sleeve garment assembly 101, elements which are analogous to the respective elements of the assembly 1 that was heretofore described with respect to FIGS. 1-5 are designated by the same numeral in the 101-199 series in FIGS. 6-12. As illustrated in FIG. 12, the sleeve garment assembly 101 may include multiple assembly accessories 144 which can be interchangeably attached to the assembly sleeves 132 depending on a desired application. The assembly sleeves 132 may be structurally independent and individually and separately releasably fastenable to a selected one of the interchangeable assembly accessories 144. For example and without limitation, in some embodiments, the assembly accessories 144 may include at least one assembly crest 102 (FIGS. 6 and 7); at least one assembly hood 160 (FIG. 9); and/or at least one assembly backpack 166 (FIG. 10) Which interchangeably interconnect the assembly sleeves 132 to each other in the sleeve garment assembly 101.

Figure 6:
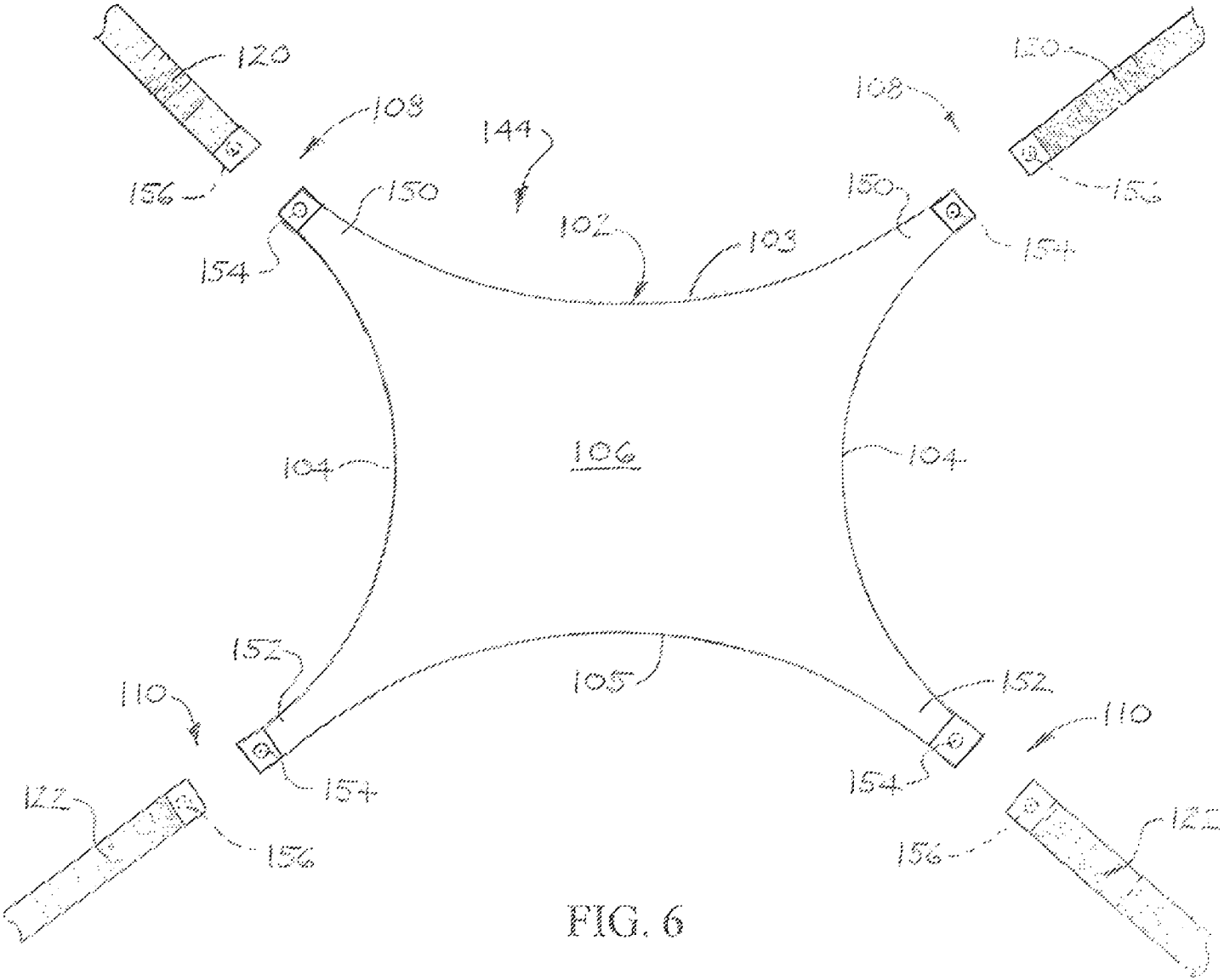
FIG. 6 is an exploded front view of a typical assembly crest of an alternative illustrative embodiment of the sleeve garment assembly.

As illustrated in FIG. 6, in some embodiments, the assembly crest 102 of the assembly accessories 144 may include a concave upper crest edge 103, concave side crest edges 104 and a concave lower crest edge 105. A pair of upper corner extensions 150 may extend between the upper crest edge 103 and the respective side crest edges 104. A pair of lower corner extensions 152 may extend between the lower crest edge 105 and the respective side crest edges 104. Each of a pair of upper strap connectors 108 may include a first connector element 154 provided on a corresponding upper corner extension 150 and a second connector element 156 provided on a corresponding upper strap 120. Each of a pair of lower strap connectors 110 may include a first connector element 156 on the respective upper straps 120 with the first connector elements 154 on the respective upper corner extensions 150. Likewise, the assembly crest 102 may be detachably attached to the lower straps 122 by detachable engagement of the second connector elements 156 on the respective lower straps 122 with the first connector elements 154 on the respective lower corner extensions 152. Each of the upper strap connectors 108 and the lower strap connectors 110 may include any type of connector known by those skilled in the art including a quick connect/disconnect coupling, a buckle, snaps or hook and loop fasteners, for example and without limitation. In alternative embodiments, the assembly accessories 144 may include at least one assembly crest 2 having a design which is the same as or similar to that of the sleeve garment assembly 1 heretofore described with respect to FIGS. 1-5 or may have any other shape such as octagonal, rectangular, polygonal or in the shape of an animal, for example and without limitation.

Figure 7:
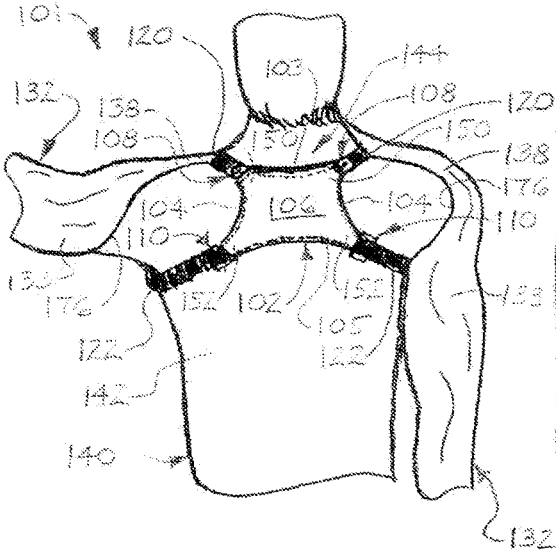
FIG. 7 is a rear view of the illustrative sleeve garment assembly including the assembly crest of FIG. 6, donned by a wearer.
Figure 8:
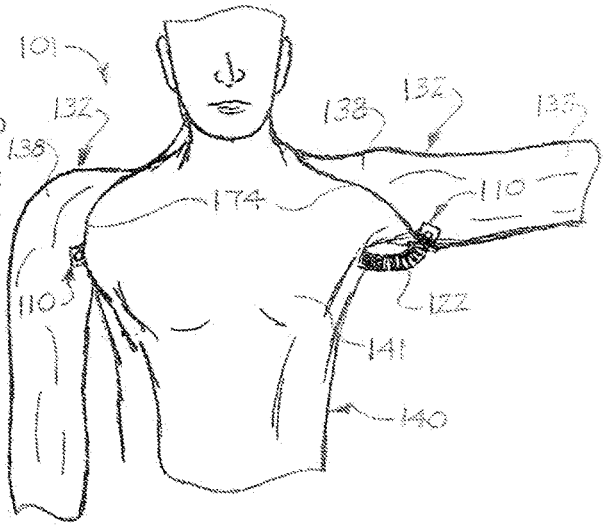
FIG. 8 is a front view of the illustrative sleeve garment assembly including the assembly crest of FIG. 6, donned by a wearer.
Figure 9:
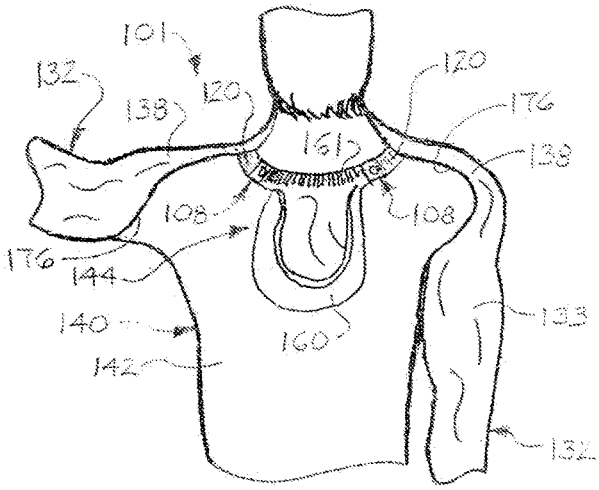
FIG. 9 is a rear view of the illustrative sleeve garment assembly donned by a wearer, with an assembly hood replacing the assembly crest of FIG. 6 and interconnecting the assembly sleeves to each other in the assembly.

As illustrated in FIGS. 9 and 12, in some embodiments, the interchangeable assembly accessories 144 of the sleeve garment assembly 101 may include at least one assembly hood 160. Accordingly, in applications in which the wearer 140 desires to have the option of wearing the assembly hood 160 on the wearer's head, the assembly hood 160 may be attached to the assembly sleeves '132 in place of the assembly crest 102 (FIG. 7). The assembly hood 160 may include a hood strap 161 which may be fastened to the upper straps 120 via the respective upper strap connectors 108. The lower straps 122 and lower strap connectors 110 (FIG. 7) may be omitted from the sleeve garment assembly 101 in use of the assembly hood 160 or in use of any other assembly accessory which only requires the upper straps 120.

As illustrated in FIGS. 10 and 12, in some embodiments, the interchangeable assembly accessories 144 of the sleeve garment assembly 101 may include at least one assembly backpack 166. Accordingly, in applications in which the wearer 140 desires to have the option of carrying items in the assembly backpack 166, the assembly backpack 166 may be attached to the assembly sleeves 132 in place of the assembly crest 102 (FIG. 7) and the assembly hood 160 (FIG. 9). The assembly backpack 166 may be detachably fastened to the upper straps 120 via the respective upper strap connectors 108 and to the lower straps 122 via the respective lower strap connectors 110.

As illustrated in FIG. 11, in some applications, the assembly backpack 166 may be selectively detached from the assembly sleeves 132 (FIG. 10) of the sleeve garment assembly 101 and used as a conventional backpack. Accordingly, a pair of backpack straps 167 may include a respective pair of first strap connectors 168 and a respective pair of second strap connectors 170. The backpack straps 167 may be fastened to the assembly backpack 166 by engagement of the first strap connectors 168 with the respective first connector elements 154 on the assembly backpack 166 and engagement of the second strap connectors 170 with the respective second connector elements 156 on the assembly backpack 166. The wearer 40 can don the assembly backpack 166, either with or without wearing the assembly sleeves 132, by inserting the wearer's arms through the backpack straps 167 and supporting the backpack straps 167 on the wearer's shoulders, typically in the conventional manner.

It will be appreciated by those skilled in the art that the assembly accessories 144 may include a variety of accessories which can be interchangeably attached to the assembly sleeves 132 for a variety of aesthetic and/or functional purposes. Non-limiting examples of the assembly accessories 144 which can be used in implementation of the sleeve garment assemblies 101 include the assembly crest 2 (FIGS. 1-5) or the assembly crest 102, the assembly hood 160 and the assembly backpack 166 which were heretofore described with respect to FIGS. 6-12. Other non-limiting examples of the assembly accessories 144 which are suitable for the sleeve garment assemblies 101 include storage compartments; light or light-reflective systems; hydration systems; communications systems; garment upgrades such as hoods, collars, costume capes and umbrellas; and protective wear such as back or neck supports. In other applications, the garment assemblies can be worn for coverage or protection of the wearer's arms. In applications in which it is desired that an assembly sleeve cover only one of the wearer's arms and the other of the wearer's arms is to remain exposed, an arm loop (not illustrated) may be attached to the assembly accessory in place of the omitted assembly sleeve and slid over the wearer's uncovered arm. In some applications, the assembly accessory 144 may include a vest (not illustrated) which is worn by the wearer to simulate the appearance of a conventional jacket. The components of the assembly accessory 144 may be worn over or under the vest depending on the desired appearance of the wearer.

In some applications, the sleeve garment assemblies may be worn by fans at sporting events. Accordingly, the assembly sleeves and the assembly crest or other assembly accessory may display the colors of the wearer's team and the team name, logo and/or other information may be displayed on the assembly crest. The sleeve garment assemblies may be worn by participants in team sports in which the player number of the wearer appears on the assembly crest. In other applications, police officers may don a sleeve garment assembly having dark assembly sleeves and colored lights on the assembly crest or other assembly accessory while directing traffic. Military training exercises may utilize a sleeve garment assembly having camouflaged assembly sleeves and a reflective orange assembly crest for safety. Military operations may utilize an assembly backpack or other assembly accessory in place of the assembly crest. Police training or operations may utilize a bulletproof vest as the assembly accessory with reinforced materials including elbows and shoulder pads on the assembly sleeves. Rodeo training may utilize leather assembly sleeves with an assembly crest in the shape of a Texas star or other like emblem with added neck support.

While certain illustrative embodiments of the disclosure have been described above, it will be recognized and understood that various modifications can be made to the embodiments and the appended claims are intended to cover all such modifications which may fall within the spirit and scope of the disclosure.

What is claimed is:

1. A sleeve garment assembly, comprising:

a plurality of interchangeable assembly accessories including at least one assembly crest, at least one assembly hood and at least one assembly backpack;

at least one pair of strap connectors carried by each of the plurality of interchangeable assembly accessories;

at least one pair of straps detachably attached to the at least one pair of strap connectors, respectively, of a selected one of the plurality of interchangeable assembly accessories;

a pair of backpack straps detachably connected to the at least one assembly backpack in interchangeable relationship to the at least one pair of straps;

a pair of structurally independent assembly sleeves individually detachably fastenable to a selected one of the plurality of interchangeable assembly accessories, each of the pair of assembly sleeves including:

an upper arm segment having first and second ends;

an accessory attachment flap extending from the first end of the upper arm segment, the accessory attachment flap attached to each corresponding one of the at least one pair of straps; and a forearm segment extending from the second end of the upper arm segment.

2. The sleeve garment assembly of claim 1 wherein the at least one pair of strap connectors comprises at least one pair of tab receivers carried by each of the plurality of interchangeable assembly accessories and at least one pair of connector tabs carried by the at least one pair of straps, respectively, and releasably engaging the at least one pair of tab receivers, respectively, on the selected one of the plurality of interchangeable assembly accessories.

3. The sleeve garment assembly of claim 1 further comprising a wristband terminating the forearm segment of each of the pair of assembly sleeves and a glove extending from the wristband.

* * * * *